United States Patent [19]

Magens

[11] Patent Number: 4,998,858

[45] Date of Patent: Mar. 12, 1991

[54] INDUSTRIAL TRUCK FOR PICKING UP A LATERALLY DISPOSED LOAD

[75] Inventor: Ernst-Peter Magens, Ammersbek, Fed. Rep. of Germany

[73] Assignee: Firma Jungheinrich Unternehmensverwaltung KG, Hamburg, Fed. Rep. of Germany

[21] Appl. No.: 280,132

[22] Filed: Dec. 5, 1988

[30] Foreign Application Priority Data

Dec. 3, 1987 [DE] Fed. Rep. of Germany ..... 3740979

[51] Int. Cl.[5] ..... B66F 9/14

[52] U.S. Cl. ..... 414/495; 414/282; 414/500; 414/631; 414/663; 414/498

[58] Field of Search ..... 414/282, 284, 495, 498, 414/659, 660, 662, 663, 500, 608, 631

[56] References Cited

U.S. PATENT DOCUMENTS

| | | | |
|---|---|---|---|
| 2,833,435 | 5/1958 | Levy . | |
| 2,989,202 | 6/1961 | De Canniere et al. . | |
| 3,392,858 | 7/1968 | Fernstrom et al. | 414/495 |
| 3,737,062 | 6/1973 | Schnell | 414/631 |
| 3,739,931 | 6/1973 | Bowman-Shaw | 414/631 |
| 4,027,771 | 6/1977 | Adams | 414/495 |
| 4,103,795 | 8/1978 | Miller | 414/498 X |
| 4,365,921 | 12/1982 | Brouwer et al. | 414/631 X |
| 4,801,238 | 1/1989 | Pezzolato | 414/608 X |

FOREIGN PATENT DOCUMENTS

| | | | |
|---|---|---|---|
| 254770 | 6/1967 | Austria . | |
| 1019968 | 11/1957 | Fed. Rep. of Germany . | |
| 1019969 | 11/1957 | Fed. Rep. of Germany . | |
| 1890182 | 4/1962 | Fed. Rep. of Germany . | |
| 1245561 | 7/1967 | Fed. Rep. of Germany | 414/495 |
| 1456587 | 2/1969 | Fed. Rep. of Germany | 414/631 |
| 1283152 | 7/1969 | Fed. Rep. of Germany . | |
| 1242571 | 6/1960 | France . | |
| 1252876 | 12/1960 | France . | |
| 1259944 | 3/1961 | France . | |
| 1323373 | 2/1963 | France . | |
| 0559269 | 3/1957 | Italy | 414/631 |
| 0789042 | 1/1958 | United Kingdom | 414/631 |
| 0843768 | 8/1960 | United Kingdom | 414/608 |
| 1377954 | 12/1974 | United Kingdom . | |
| 1553292 | 9/1979 | United Kingdom . | |
| 2087345 | 5/1982 | United Kingdom | 414/663 |

*Primary Examiner*—Robert J. Spar
*Assistant Examiner*—John VandenBosche
*Attorney, Agent, or Firm*—Toren, McGeady & Associates

[57] ABSTRACT

An industrial truck for picking up a laterally disposed load from the ground or from racks comprises at least one chassis beam, which extends transversely to the longitudinal direction of the track, an extending and retracting drive for laterally moving a load carrier subassembly including load carrier arms. A lifting drive is provided for vertically moving the load carrier subassembly relative to at least chassis beam. The load carrier arms of the forked load carrier or corresponding roller-carrying arms, which are transversely movable, are provided with downwardly extensible load-supporting rollers, which are adapted to support the load during a transverse movement of the load carrier.

11 Claims, 8 Drawing Sheets

INDUSTRIAL TRUCK FOR PICKING UP A LATERALLY DISPOSED LOAD

BACKGROUND OF THE INVENTION

1. Field of the Invention

This invention relates to an industrial truck for picking up a laterally disposed load from the ground or from racks, comprising at least one chassis beam, which extends transversely to the longitudinal direction of the truck and is provided on its parallel sides with guiding means for guiding a load carrier subassembly during its lateral displacement, which subassembly particularly comprises load carrier arms, which are movable beyond the contour of the industrial truck or of side beams and have fork arms which are connected by a crosspiece for guiding said arms on the guiding means, also comprising a feed drive for extending and retracting the load carrier and a lifting drive for vertically moving the load carrier relative to at least one chassis beam.

The reference to the picking up of a laterally disposed load involves the handling as such and includes also the deposition of a load.

The term load carrier subassembly generally describes a forked load carrier but does not exclude a load carrier subassembly which comprises a lifting frame, which is provided with a carriage that carries load carrier arms, which on an adjustable level are adapted to be extended into and to be retracted from shelves.

2. Description of the Prior Art

Industrial trucks of the kind described hereinbefore may be designed for an operation under the control of a driver but are preferably designed for an operation without a driver and in the latter case are guided and moved to register with locations on racks by means of guiding leads installed in the ground.

If a load carrier is to be laterally displaced for a picking up and deposition of loads when the truck is disposed in a narrow passage between racks, the crosspiece of the forked load carrier can be guided in known manner by guiding means comprising at least one roller and optional additional supports. Laterally extensible load carriers or fork arms are held freely and are not held in a defined elevation. There will be an elastic deformation particularly under a load.

From German Patent No. 12 83 152 it is also known to mount such load carriers on a laterally displaceable lifting frame, which is similarly guided and on which the load carrier can be extended by means of a scissors mechanism. In that case a downwardly extensible prop is provided to support the load carrier on the ground. Whereas such prop may be able to take up a certain lateral load, it will not facilitate the lateral movement of the load carrier and its movement under load. As the prop can be used only when the truck is at a standstill, its use will take considerable time. Moreover, such a prop will occupy a large space and requires that the load carrier when moving will be able to carry by itself a load.

German Patent Publication No. 10 19 969 discloses a side stacker provided with a load carriage on a lifting mast, which is displaceable transversely to the longitudinal axis of the truck. The entire lifting gear can be displaced on the level of the loading platform. In that case the structure may be relatively light in weight because a frame is provided which is continuous throughout the width of the truck and the lifting gear is moved as far as to the side edge of the truck approximately on the level of the loading platform. That design has been adopted to ensure that the frame of the truck has a high strength because the frame members are continuous. The expenditure is considerable because the telescopic lifting mast must be extensible also downwardly.

In accordance with German Patent Publication No. 10 19 968, actuating cylinders for imparting a transverse displacement to a lifting mast are rotatably mounted on lugs so that the drive means can be adapted to the movement throughout the transverse displacement of the lifting mast. In that design a horizontally movable carriage is provided with two rollers moving in a groove-like track. That feature also involves a considerable expenditure because in the known designs the fork arms are held and guided by the guiding means even when the arms are under load.

Austrian Patent Specification No. 254,770 discloses a frontally operating fork lift truck comprising a mast-base unit, which is movable up and down on the housing, and armlike feet disposed below said unit are provided with roller carriers, which are adapted to be raised and lowered by control rods. Those control rods are connected to a mechanism which during an up or down movement of the mast-base unit impart an axial displacement to the control rod so that load-carrying rollers will be extended. But such rollers are incorporated in the separate mast-base unit rather than on the load carrier. In that embodiment the forked load carrier has no load-supporting rollers and the loaded load carrier protrudes freely when it is under load.

It is an object of the design disclosed in Austrian Patent Specification No. 254,770 to provide a fork lift truck which has supporting legs and is as low as possible and has hollow forks, which can rest on the supporting legs. But that object can be accomplished only with restrictions when the fork arms of the load carrier are disposed over the mast-base unit and involves a considerable expenditure.

SUMMARY OF THE INVENTION

It is an object of the invention to provide a side stacker, which may have or may not have a mast, i.e., an industrial truck for picking up a laterally disposed load, which truck should be designed in consideration of the aspects discussed hereinbefore and should permit loads reliably to be handled even as the load carrier is extended beyond the contour of the truck whereas the expenditure involved in the guidance of the load carrier should not be excessive and separate load support means may be used.

That object is accomplished in accordance with the invention in that the load carrier arms or corresponding transversely movable roller-carrying arms are provided with downwardly extensible load-supporting rollers. In such an arrangement the provision of roller-carrying arms will permit a reliable handling of loads by an industrial truck which is much lighter in weight and in which the stability during a lateral transport of loads will be increased. A load carrier which has picked up a load can be laterally retracted without being subjected to a lateral tilting moment and the load can thus be moved into the contours of the industrial truck and can be handled there.

It will be seen that the provision of the downwardly extensible load-supporting rollers will substantially facilitate an operation at racks even when the truck is disposed in a narrow passage between shelves.

The provision of roller-carrying arms which constitute load carrier arms will provide a low industrial truck which is of a special kind and permits a lateral movement of a load while such load is excellently supported.

This invention includes also the provision of a transversely extending chassis beam, which is provided on both sides with guiding assemblies on which the load carrier is guided on both sides.

In a particularly preferred embodiment an industrial truck comprises two chassis beams, which extend transversely to the longitudinal direction of the truck, and wheels which can be steered and/or driven, which are provided under said transverse beams, which on confronting sides comprise guiding means for guiding the laterally extensible load carrier on both sides. In that case the load carrier is held between the transversely extending chassis beams and by said beams is guided without being canted. That design results in a transport on a very low level, as is essential for numerous applications. The non-canting guidance is improved by the fact that the rollers are spaced apart.

In an industrial truck comprising a lifting frame which is provided with a carriage that carries a load carrier, it is preferred that the lifting frame is mounted on the fork crosspiece housing and is laterally movable in the guiding means and is provided with roller-carrying arms which carry load-supporting rollers which are downwardly extensible independently of the lifting movement of the load carrier feature. This will particularly be used during a time in which the load carrier proper is vertically movable by means of a lifting carriage.

A common drive is suitably provided for the lifting drive and for extending and retracting the load-supporting rollers. Alternatively, separate drives may be provided for lifting the load carrier and for extending and retracting and/or lifting the load-carrier subassembly.

In a preferred embodiment a drive is provided for a plurality of purposes, namely, for the lifting drive, for retracting and extending the load-carrying rollers and for a lateral displacement and, if different drives are provided for a lifting frame, also for the vertical movement of the load carrier. In that context the term lifting drive describes drive means which have a follower action and impart a restricted vertical movement to the roller-carrying arms or to load-carrying arms constituted by said roller-carrying arms. This will result in a particularly desirable design, which is inexpensive and space-saving.

In the preferred embodiment a suspension gear for suspending the load carrier subassembly in a retracted position is provided in the chassis and said subassembly is released from and inserted into said suspension gear in dependence on a vertical movement of the retracted load carrier subassembly, particularly with the forked load carrier, which may include the roller-carrying arms. The provision of said suspension gear will be preferred because when the load carrier or the roller-carrying arms are in their retracted position it will be possible to relieve other components and to effect a stable support without a loading of rollers or roller-guiding tracks and bearings for rollers.

In that connection such a suspension gear may also be combined with the lifting frame and the arrangement may be such that the forked load carrier is movable on the lifting frame and only the roller-carrying arms provided with the extensible load-supporting rollers remain on a lower level.

A special feature resides in the provision of load supports for loads which have been retracted into the industrial truck. This will result in a relief and in a stable support.

In an embodiment comprising a lifting drive for the load carrier subassembly it will be desirable to connect the lifting drive and the mechanism for extending the load-supporting rollers and to cause the load-supporting rollers to be correspondingly extended in response to an operation of the lifting drive to raise the load carrier subassembly. This will ensure a constant support of the laterally extensible subassembly.

From the latter aspect it will be particularly preferred that the common lifting drive is a double-acting cylinder-piston device, which acts at one end on a fork cross-piece housing and at the other end on a crossbar or a transverse rod which extends through said housing and carries rotatably mounted guide rollers, which are disposed outside the fork arms cross-piece housing and are vertically liftable from said housing and roll on tracks provided on the industrial truck, particularly on chassis beams, said crossbar or rod carries slotted cam plates formed with cam slots, in which pivoted arms are guided, which serve to actuate an adjusting linkage for imparting a vertical movement to the load-carrying rollers, and the fork crosspiece housing is movable in height relative to the crossbar or rod.

That embodiment affords the advantage that the same drive is used to extend the load-carrying rollers and to raise the fork crosspiece housing and that it is ensured that the load-supporting rollers will be completely retracted during the retracting movement. Besides, a stable position will be obtained in that the guide rollers will not be loaded when the load carrier is held in the suspension gear.

In accordance with the above remarks the end position can be reached only when the load carrier has entirely been retracted to the position in which the load carrier engages the suspension gear.

In view of the above, bearing means for the extensible load-supporting rollers constitute in the retracted position a limit stop, which defines an end position of the double-acting cylinder-piston device, and the guide rollers are lifted from the tracks in said end position. That reliable holding of the load-supporting rollers and its retraction to a defined position can be achieved with a single cylinder-piston device. This constitutes a particularly desirable advantage afforded by the invention.

In another highly favorable embodiment of the invention a roller guide is provided between the load carrier subassembly including load carrier arms, on the one hand, and the guiding means, said roller guide guides the load carrier in horizontal orientation, and a separate extending and retracting drive is provided for actuating the extensible load-supporting rollers. In the preferred embodiment in which the load carrier is provided with load-supporting rollers this feature will be desirable because the load carrier can be moved under no load, e.g., with the load-supporting rollers retracted, and will not strike against bottom crossbars of a pallet as the load carrier is moved into such pellet, whereas the load-supporting rollers can be extended as desired when the load has been applied and the load-supporting rollers can be extended to a desired level if a separate extending and retracting drive is provided. That arrangement will result in an industrial truck which can operate quickly and is relatively light in weight even when used to handle considerable loads.

In a preferred arrangement the roller guide consists of at least two rollers, which are pivoted to the load carrier and connected to springs, which urge the roller guide to a position in which said roller guide is parallel to the load carrier.

In that embodiment the roller guide may be mounted in guide means consisting of inwardly open channel bars. The springs are so strong that they will not be deflected under a normal load. But a deflection will be effected to ensure that an overloading of the guide for the load carrier will be prevented when the truck is moving through a dip and the load-supporting rollers have been extended. In that case, irregularities of the ground can be taken up by the restricted yieldability. Limit stops for limiting the pivotal movement of the two rollers of the roller guide are suitably provided. Said rollers move in channel bars, which are disposed on both sides of an open toward the load carrier and constitute the guiding means. That design will prevent an excessive deviation but the limit stops will take up loads.

In another desirable embodiment provided under the aspects set forth hereinbefore the roller guide comprises two guide rollers, which run on a track rail that consists of a solid beam and constitutes the guiding means, and a spring-loaded guide roller, which applies a back pressure and is mounted on the carriage for said guide rollers and applies pressure to the bottom of the solid beam. In that embodiment, other guide means consisting of protruding track rails are used and the desirable feature is provided that the load carrier arms are guided in parallel until a predetermined load has been applied.

DETAILED DESCRIPTION OF THE PREFERRED EMBODIMENTS

Figure 1:
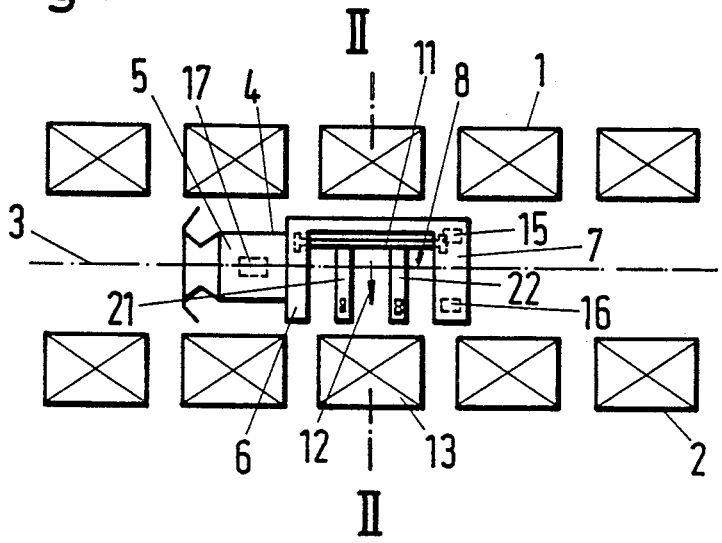
FIG. 1 is a diagrammatic top plan view showing an industrial truck in a passage between racks.

FIG. 1 shows a passage between racks 1, 2. Only the stack-receiving compartments on one level are indicated for each of said racks. A guiding element 3 is fixed to the ground at the center between the shelves 1, 2. The guiding element may effect an inductive guidance, an optical guidance or a mechanical guidance. For that purpose it is known to effect an inductive guidance by a guiding wire, which is embedded in the ground and which is energized to establish a field and the strength of said field on both sides of the guide element proper is detected by sensors and used to steer the vehicle.

Such an industrial truck 4 is shown on the drawing. It comprises a truck body 5 having chassis beams 6, 7, which extend transversely to the longitudinal direction of the truck. Guide means are provided on confronting parallel side faces of the chassis beams 6, 7 and guide a load carrier subassembly 8, which comprises two load carrier arms 21, 22 which constitute a fork together with a crosspiece 11, which may consist of a housing. The load carrier subassembly 8 is laterally extensible in the direction of the arrow 12 by a separate drive. Lifting drives are also provided and will be described more in detail with reference to FIGS. 15 et seq.

It is apparent from FIG. 1 that the load carrier arms 21, 22 of the forked load carrier can be extended into or under a load 13 in the shelves 2 and can lift such load and retract it into the contour of the industrial truck 4.

For explanation it is pointed out that the invention provides a load carrier subassembly comprising roller-carrying arms and an optional lifting frame. That load carrier subassembly comprises load carrier arms 21, 22, which constitute roller-carrying arms because they are provided with downwardly extensible load-carrying rollers 23, 24. The load carrier subassembly basically comprises such load carrier arms 21, 22, which consist of roller-carrying arms.

Figure 10:
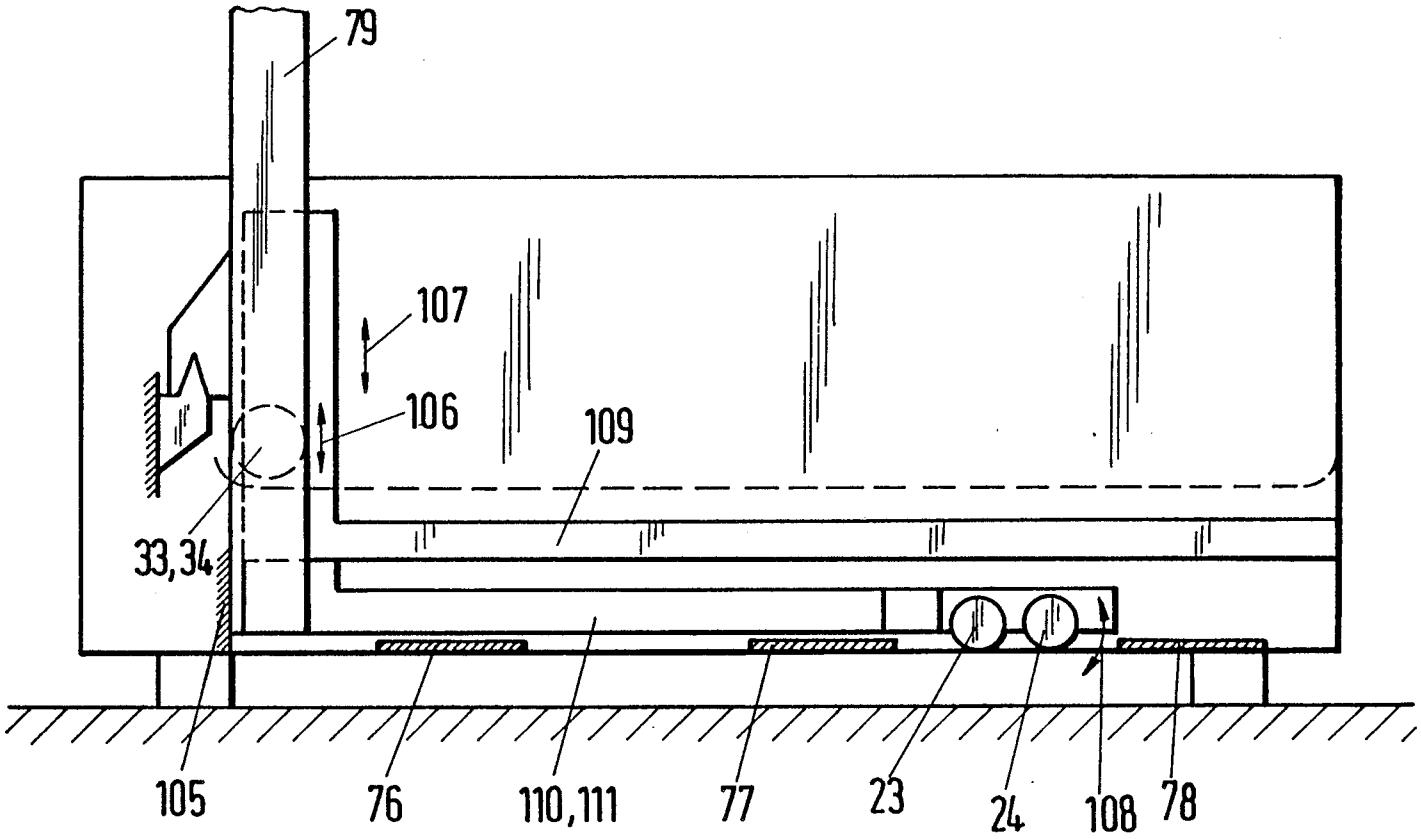
FIG. 10 is a diagrammatic vertical sectional view illustrating an embodiment in which the fork crosspiece housing has been supplemented by a lifting frame, in which a separate load carrier is vertically movable in known manner independently of the movement of the load-supporting and guide rollers and a load carrier consisting of a carriage provided with load carrier arms is mounted on the lifting frame.

In another embodiment, the load carrier subassembly 8 may comprise a lifting frame, such as is shown in FIG. 10, and such lifting frame in addition to the load carrier arms 21, 22 provided with the load-supporting rollers and mounted on the lifting carriage may be provided with load carrier arms 109. To emphasize that distinction in the subsequent description, the arms which directly carry the load will be described as load carrier arms 21, 22 provided on the underside with load-supporting rollers. Additional arms are designated, e.g., 110 and 111 in FIG. 10 and are provided with load-supporting rollers 23, 24 and will be described as roller-carrying arms.

Figure 2:
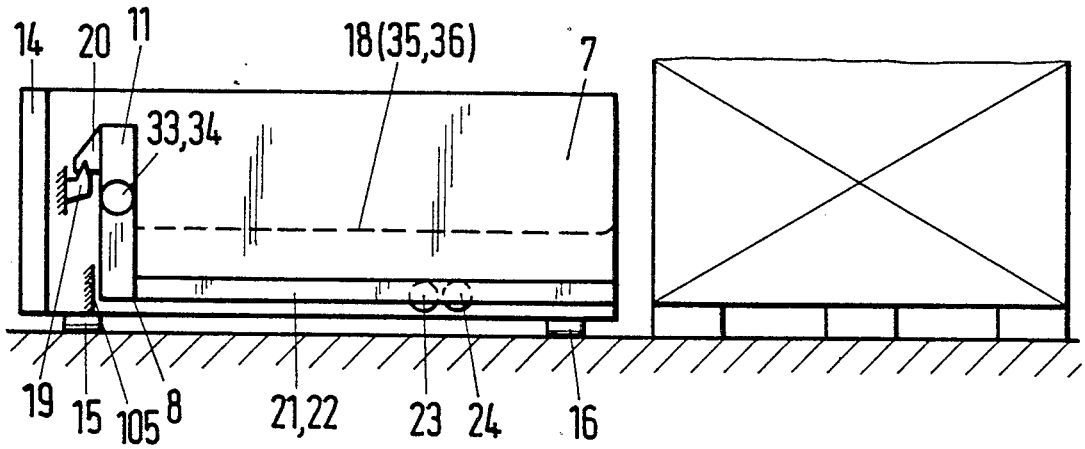
FIG. 2 is a diagrammatic vertical longitudinal sectional view taken on line II—II in FIG. 1 in an initial position.
Figure 3:
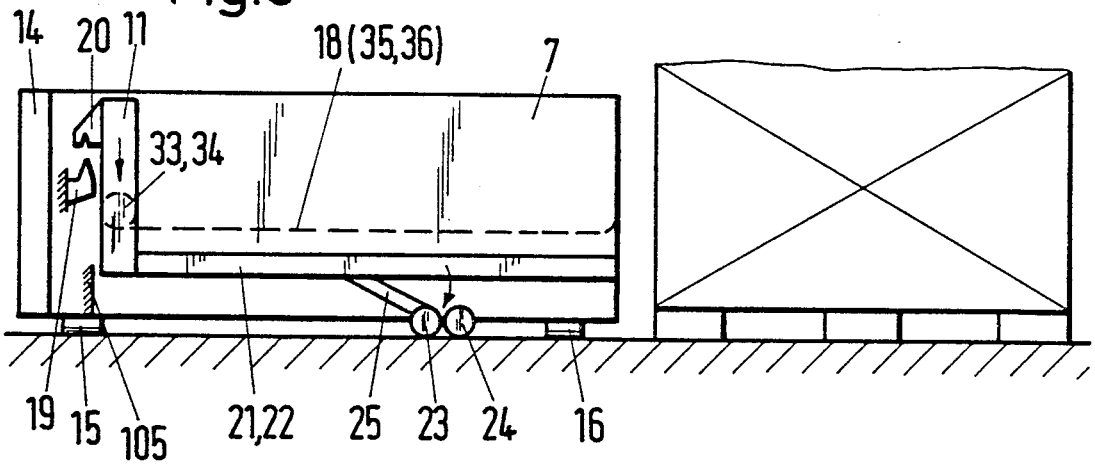
FIG. 3 is a view that is similar to FIG. 2 and shows the truck in a different operating position.
Figure 4:
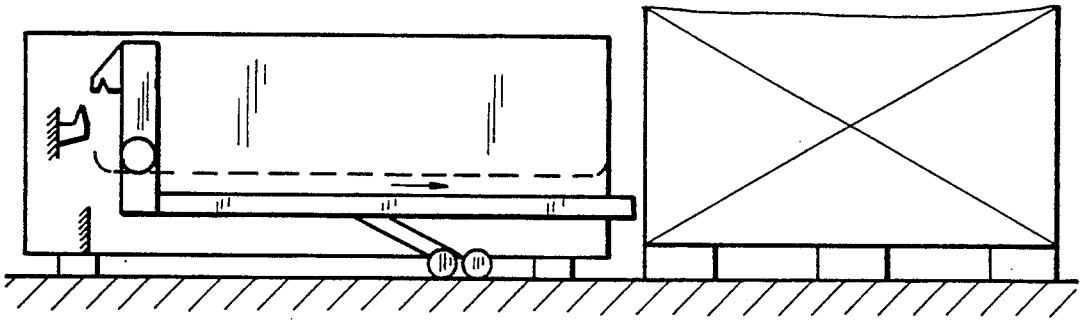
FIGS. 4 to 9 show the industrial truck in various operating positions assumed during the handling of a pallet.

FIGS. 2 and 3 are sectional views taken on line II—II in FIG. 1. The chassis beam 7 of the industrial truck is apparent, which is connected by the longitudinal beam 14 to the other chassis beam 6 to provide a chassis for the industrial truck. It is apparent from FIGS. 2 and 3 that the two wheels 15, 16 are mounted in the chassis beam 7 and can be used to move the truck by means of the travel drive and under the control of the driven steerable wheel 17 mounted in the body 5 of the truck.

The two chassis beams 6, 7 are provided with guiding means 18, one of which is shown in FIGS. 2 and 3. Such guiding means may comprise a track, such as will be described with reference to FIG. 15, and are provided on both sides of the load carrier subassembly 8 and secured to the confronting sides of the two chassis beams 6, 7. In the formal illustrations of FIGS. 2 and 3, the guide rollers 33, 34 rest on the guiding means, which in the present case consist of a track indicated by broken lines. In FIG. 2 the guide rollers 33, 34 are shown in the lifted position which they assume when the load carrier subassembly is suspended.

The chassis beam 7 is a part of the industrial truck, other parts of which are not shown. The chassis beam 7 is provided with an open-topped suspension hook 19, which has a knife edge, in which a knife edge bearing 20 may be mounted, which is included in a suspension or receiving gear of a fork crosspiece housing 11.

FIGS. 2 and 3 show also the abutments 105, which are provided on the bottom of the chassis and are engageable by the bottom of the fork crosspiece 11 or the fork crosspiece housing when the suspension hook 19 engages the knife edge bearing 20 of the suspension gear.

In that connection it may be mentioned that the load carrier arms 21, 22 of the load carrier subassembly are secured to the housing 11 in a fixed angular position. Load-supporting rollers 23, 24 are mounted under said load-carrier arms and are arranged in pairs of rollers mounted in a rockerlike or rigid carrier. Said load-carrying rollers 23, 24 or the carrier for such rollers can be extended and retracted in dependence on the instantaneous position of the load carrier subassembly 8. The load-supporting rollers 23, 24 are mounted in known manner on a pivoted lever 25, which by a linkage to be described hereinafter is movable in height relative to the industrial truck or the chassis beam 7 in dependence on the vertical movement of the load carrier subassembly so as to effect a disengagement in the region 19, 20 and a support on the load-supporting rollers 23, 24 whereas the guide rollers 33, 34 are lowered and to effect an engagement in response to an oppositely directed movement of the load-supporting and/or guide rollers 33, 34.

Before a description of the further figures, the drive will be explained with reference to FIGS. 14 to 17.

Figures 14, 14A:
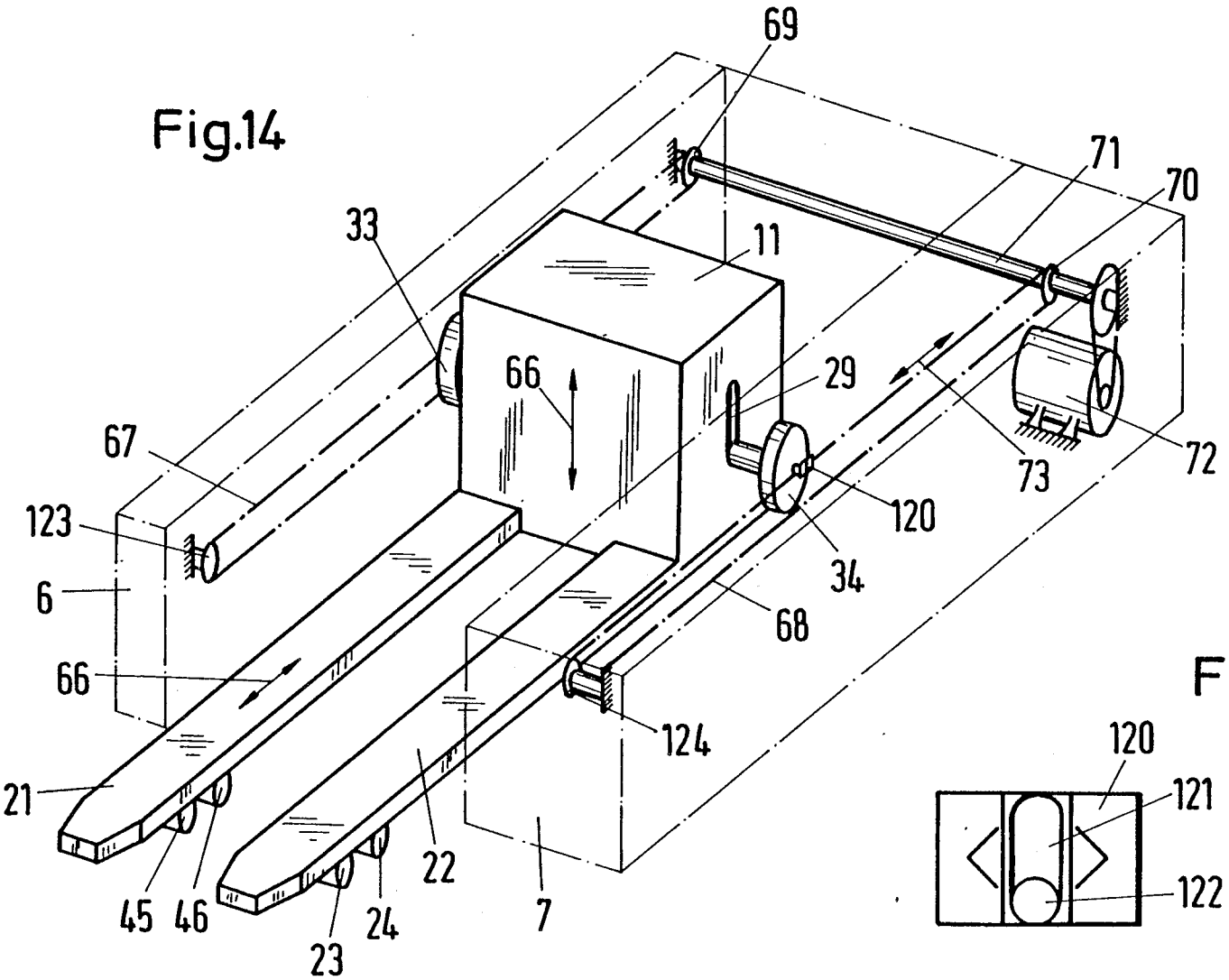
FIG. 14 is a fragmentary perspective view showing an embodiment of the invention for an explanation of the drives.
FIG. 14*a* shows a fragmentary elevation showing a part of FIG. 14.
Figure 15:
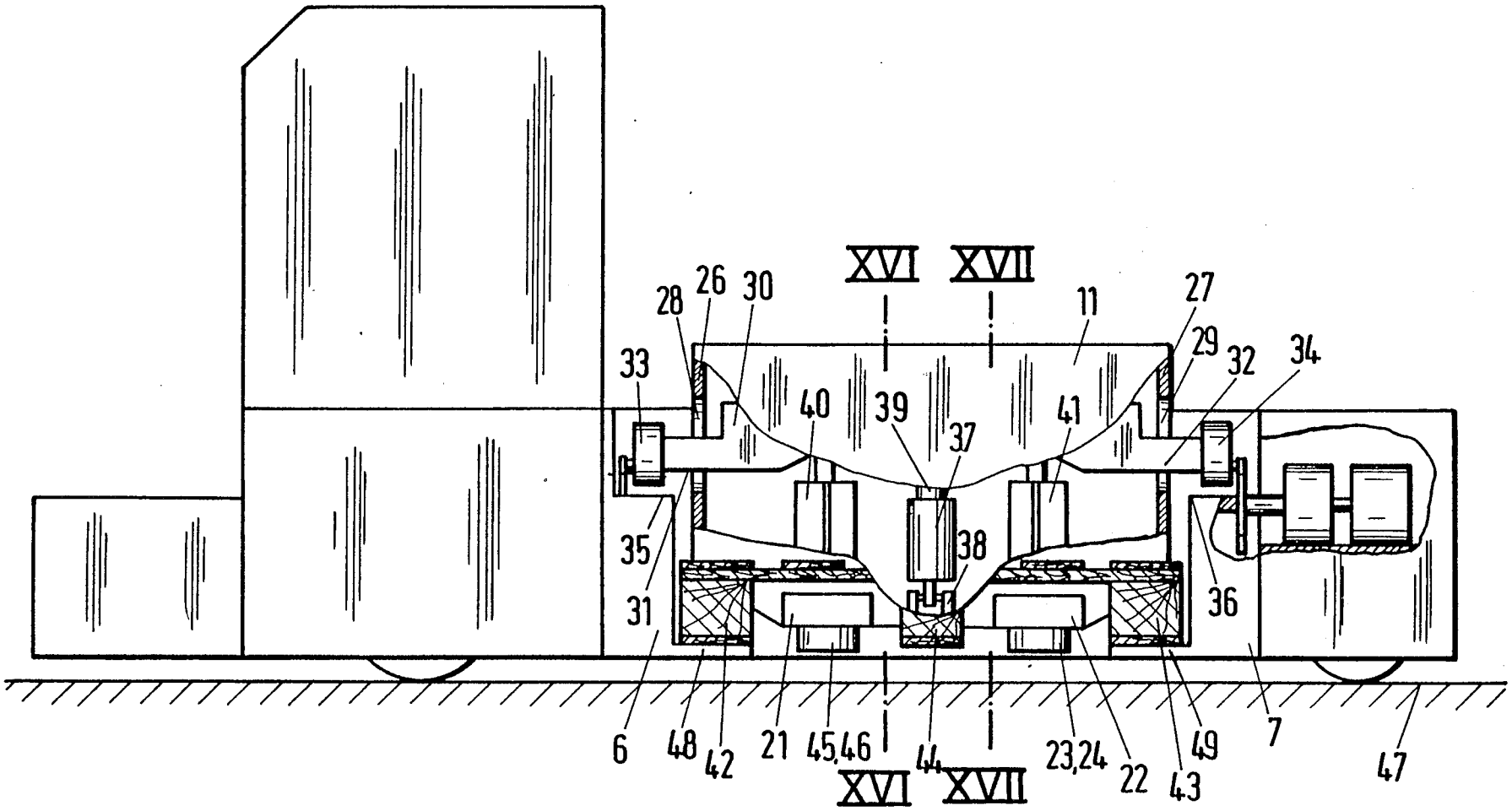
FIG. 15 is a fragmentary longitudinal sectional view showing in an end view a forked load carrier provided with a fork crosspiece housing and supports provided on the truck.

The fork crosspiece housing 11 shown in FIGS. 14 and 15 carries on its underside the two load carrier arms 21, 22. The housing 11 is formed in its side walls 26, 27 with longitudinal slots 28, 29, through which stub axles 31, 32 of a crossbar 30 extend so that the crossbar 30 is guided against being canted. Guide rollers 33, 34 are freely rotatably mounted on the stub axles and run on and can be lifted from tracks 35, 36 of the chassis beams 6, 7.

A double-acting hydraulic cylinder-piston device 37 is firmly connected by an articulated joint to the crossbar and at the bottom of its cylinder is connected by a swivel bearing 38 to the bottom 11. The piston 39 of the device 37 extends out of the cylinder and is pivoted to the crossbar 30. Slotted cam plates 40, 41 are pivoted in the housing 11 by other means and are vertically movable in contact with the wall portions which extend parallel to the drawing plane of FIG. 15. One of said slotted cam plates 40, 41 will be explained more in detail with reference to FIG. 17.

In the position shown in FIG. 15 the load carrier arms 21, 22 have been extended to enter a pallet comprising parts 42 to 44, as well as the top and bottom of housing pallet boards indicated by broken lines. The top pallet board is continuous and is provided with support strips. When it is desired to extend the load carrier arms 21, 22 into the pallet, the load-supporting rollers 23, 24 or 45, 46 may be retracted and extended relative to the roller-carrying arms or, in FIG. 15, relative to the load carrier arms. In the position shown in FIG. 15 the load-supporting rollers 23, 24; 45, 46 have been lifted from the ground 47 and the parts 42, 43 of the pallets are supported on load supports 48, 49 corresponding to the load supports 76 to 78 in FIGS. 10 and 11 and provided on the chassis beams 6, 7.

In that initial position the guide rollers 33, 34 are lifted from the associated tracks 35, 36.

Because the cylinder-piston device 37 is double-acting, the fork crosspiece housing 11 can be raised relative to the guide rollers 34 so that the roller-carrying arms are raised. Because the slotted cam plates 40, 41 remain in their initial elevation relative to the tracks provided on the chassis beams, the load-supporting rollers 23, 24; 45, 46 will be extended as shown in FIG. 17.

As the cylinder-piston device 37 is extended, the fork crosspiece housing 11 is first lowered relative to the guide rollers 33, 34. Because the slotted cam plates 40, 41 remain in their initial elevation relative to the tracks, the load-supporting rollers 23, 24; 45, 46 are swung inwardly. The downward movement is continued until the load-supporting rollers engage a stop. That movement causes the fork crosspiece housing to hang itself on the suspension hook 19 so that the housing remains in its upper position but the guide rollers 33, 34 will be lifted from the tracks. The resulting position is apparent also from FIG. 10.

Figure 16:
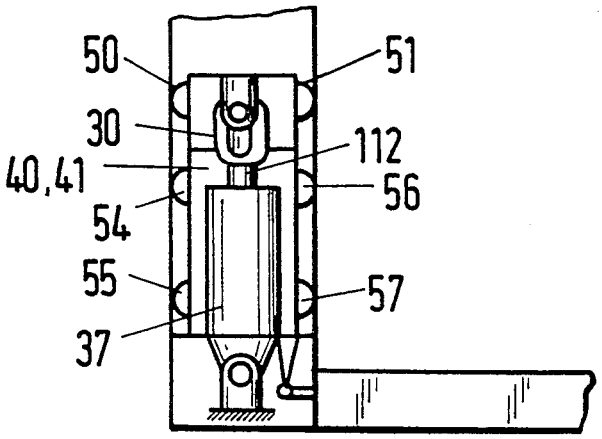
FIG. 16 is a sectional view taken on line XVI—XVI in FIG. 15.

FIG. 16 shows the cylinder-piston device 37, the slotted cam plates 40, 41 and the crossbar 30. A connection is shown here which is constituted by an intermediate axle. The crossbar has such a width that its side faces are guided on the side walls of the housing 11, optionally by means of two guide rollers 50, 51. Guide rollers 54, 55; 56, 57 are also mounted on the outside of the slotted cam plates 40, 41 and ensure a guidance on the side walls of the housing 11.

Figure 17:
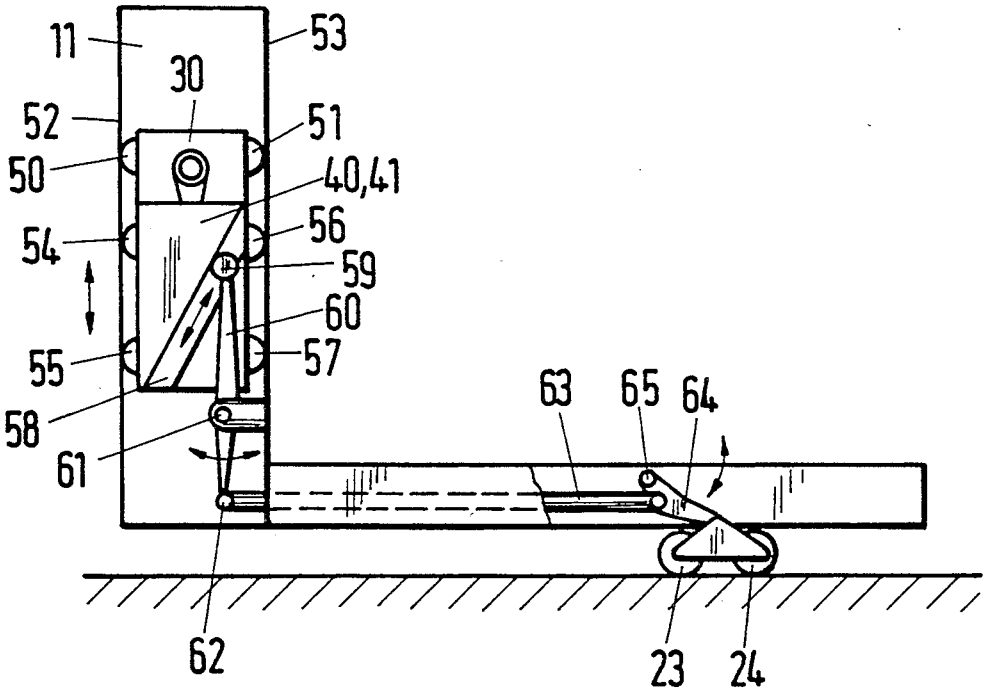
FIG. 17 is a sectional view taken on line XVII—XVII in FIG. 15.

The latter is shown also in FIG. 17, in which it is seen that the side walls 52, 53 of the housing 11 are movable on the guide rollers 54, 55; 56, 57 mounted on the slotted cam plates 40, 41 and on the guide rollers 50, 51 mounted on the crossbar 30. The slotted cam plates are formed with oblique cam slots, one of which is shown at 58 in FIG. 17 and receives a guided roller 59 that is mounted on a rocker 60, which is pivoted by a swivel bearing 61 to the fork crosspiece housing 11. The other end 62 of the rocker 60 is connected by a linkage 63 to a retracting lever 64, on which the load-supporting rollers 23, 24 are rotatably mounted and which at its upper end is articulatedly mounted at 65 in the load carrier arms.

Whereas FIG. 14 shows the guide rollers 33, 34, the track is not shown in detail therein. The two chassis beams 6, 7 are indicated. The fork crosspiece housing 11 is formed with the slot 29, by which said housing is guided in the directions indicated by the double-headed arrow 66. That guidance is effected in known manner by, e.g., two chains 67, 68, which are connected to the housing 11 and are trained around chain sprockets 69, 70 secured to a shaft 71 and around reversing sprockets 123, 124. The chains can be reciprocated by a drive motor 72 in the directions indicated by the arrow 73. The load-supporting rollers 23, 24 and 45, 46 are also apparent from FIG. 14.

Because the guide rollers 33, 34 are to be lifted from the tracks on the chassis beams 6, 7, a connecting member 120 includes in each chain is formed with a vertical slot 121, which is parallel to the slot 29 to permit such movement. As a result, in the embodiment shown in FIG. 14 the chain will be maintained in its initial elevation when the guide rollers 33, 34 have been lifted. In that embodiment the slot 121 receives a pin 122, which is mounted on the axle carrying the guide rollers 33, 34.

Reverting to FIG. 3, the corresponding side elevations shown in FIGS. 4 to 9 will now be referred to for an explanation. FIG. 2 shows an initial position, in which the load carrier subassembly 8 is supported in its position of rest and the load-supporting rollers 23, 24 have been retracted. The guide rollers 33, 34 have been lifted from the tracks 35, 36 which constitute the guiding means 18.

Figure 5:
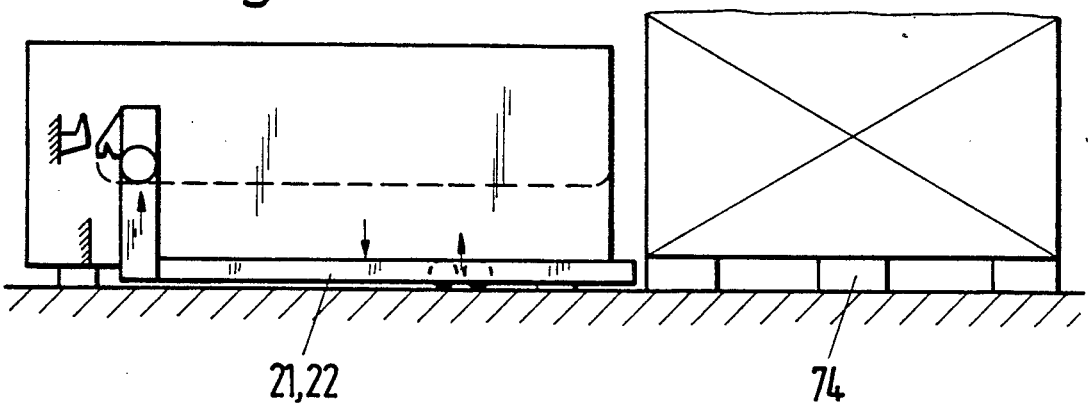
Figure 6:
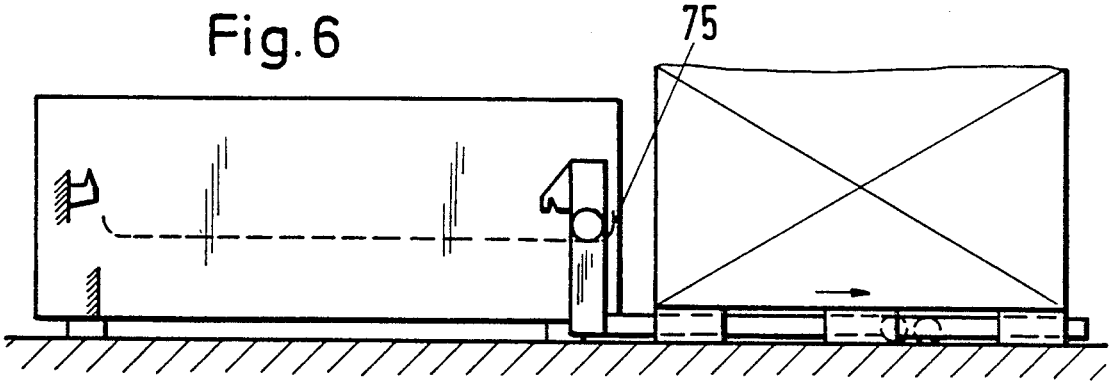
Figure 7:
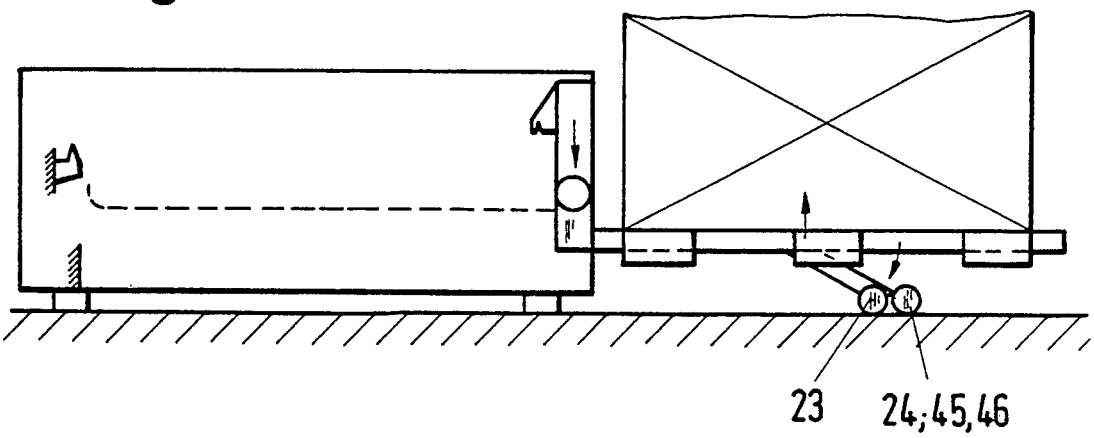
Figure 8:
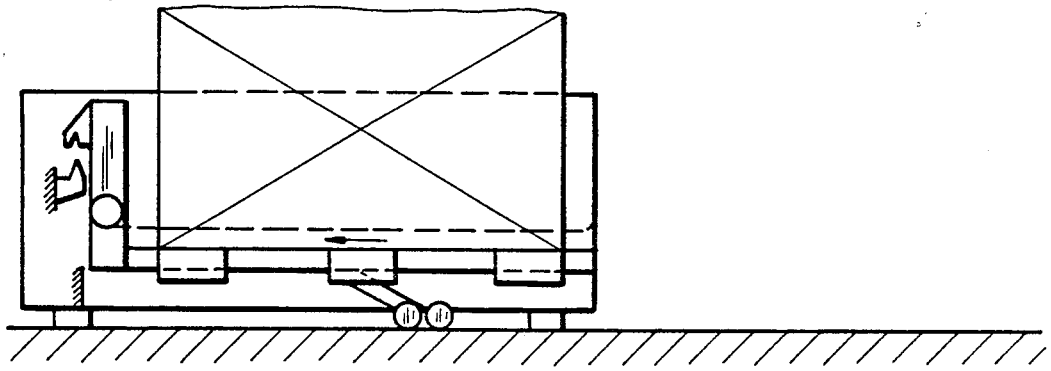
Figure 9:
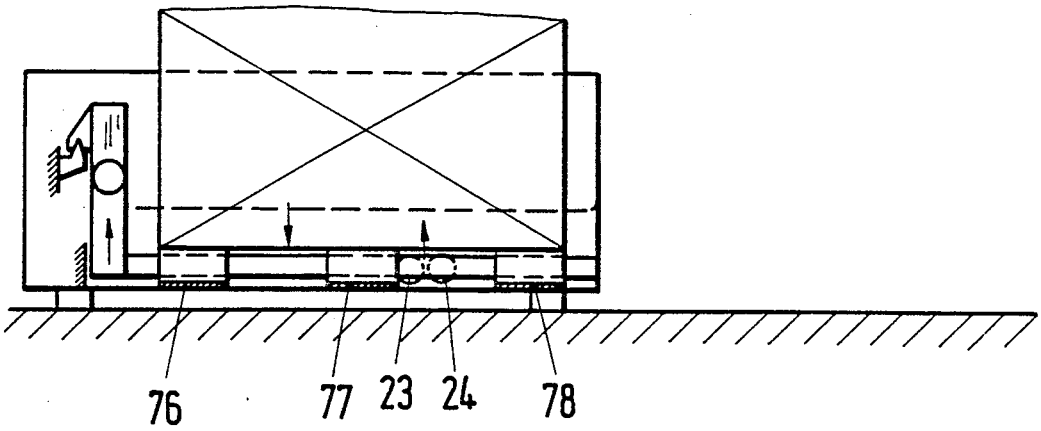

In accordance with FIG. 3 the guide rollers 33, 34 are lowered onto the tracks 35, 36 and the housing 11 is lifted from the suspension hook 19 and in the sequence of operations which will be described with reference to FIGS. 2 to 8 is moved to the right. The load-supporting rollers are extended at the same time. Special attention is directed to the functional relationships. During the sequence of operations the load carrier moves through the position shown in FIG. 4 and in accordance with FIG. 5 is lowered so that the load carrier arms 21, 22 assume a position which is so low that said arms can be extended under a pallet 74. This is shown in FIG. 6. The extending movement is limited by a limit stop 75. The lifting cylinder device is then actuated in a pallet-entering sense and the load carrier subassembly 8 is raised and the load-carrying rollers 23, 24; 45, 46 are extended after the guide rollers 33, 34 have been lowered. The load can then be retracted into the contour of the industrial truck and will stably be supported during such operation. The cylinder-piston device 37 in FIG. 15 is then actuated in an extending sense so that the position shown in FIG. 9 is reached. The load-supporting rollers 23, 24 . . . are returned and the guide rollers are lifted at the same time. The truck can now carry the load away, particularly because in accordance with the explanations given above the load has been deposited on the load supports 48, 49 (FIG. 15) or 76, 78 (FIG. 9).

The load supports extend along the edges and do not extend as far as to the center but are only short and disposed on the outside. As a result, the arrangement may be such that the load-supporting rollers 23, 24; 45, 46 may move between such load supports even when said rollers are extended. Laterally disposed load supports are designated 76 to 78 in FIG. 9. Similar remarks are applicable to FIG. 10.

A special embodiment of an industrial truck is shown in FIG. 10 and comprises a lifting frame 79, which carries load carrier arms 109 which are mounted on a vertically movable lifting carriage. The load carrier arms 109 consist of open-bottomed channels and differ from the load carrier arms 21, 22 in that they are not provided with load-supporting rollers. Such rollers are mounted on the roller-carrying arms 110, 111. That assembly comprising a lifting carriage and load carrier arms 109 is movable up and down in the directions indicated by the double-headed arrow 107 by a lifting drive, not shown. For the sake of clarity the load carrier arms 109 are shown in a position in which they are lifted from the roller-carrying arms 110, 111. In the present embodiment the roller-carrying arms may be shorter than the load carrier arms 109, which have such a sectional shape that they can be fitted on the roller-carrying arms 110, 111 so that a low height will be obtained for the movement into a pallet.

It is apparent that in the embodiment shown in FIG. 10 the load carrier subassembly 8 consists of the roller-carrying arms 110, 111 and the lifting frame 79. In that load carrier subassembly the load carrier arms 109 can be vertically moved by the carriage moving along the lifting frame.

The roller-carrying arms 110, 111 are provided with load-carrying rollers 23, 24, which can be extended and retracted. The load carrier subassembly comprising the lifting frame 79 comprises the guide rollers 33, 34, which are movable in height as in the embodiment described hereinbefore. In addition to the above-mentioned lifting drive not shown in the drawing, a second lifting drive is mounted on the truck and corresponds to the drive 37 in FIGS. 15, 16 and serves to move the guide rollers 33, 34 and the load-supporting rollers 23, 24 in the directions indicated by the double-headed arrows 106, 108. Said guide rollers are movable relative to the load carrier subassembly comprising the lifting frame 79, which is comparable to the housing 11 described hereinbefore.

It is apparent that the movements of the lifting frame 79 carrying the roller-carrying arms 110, 111 correspond to those of the housing 11 and the load carrier arms 21, 22 as explained with reference to FIGS. 2 to 9. In the embodiment shown in FIG. 10 the sequence of movements described with reference to FIGS. 2 to 9 can be performed to pick up a load from the ground and to deposit a load on the ground without a movement of the load carrier arms 109 along the lifting frame 79. But that lifting drive 79 and the associated lifting drive may be used to pick up or deposit loads on various levels.

Figure 11:
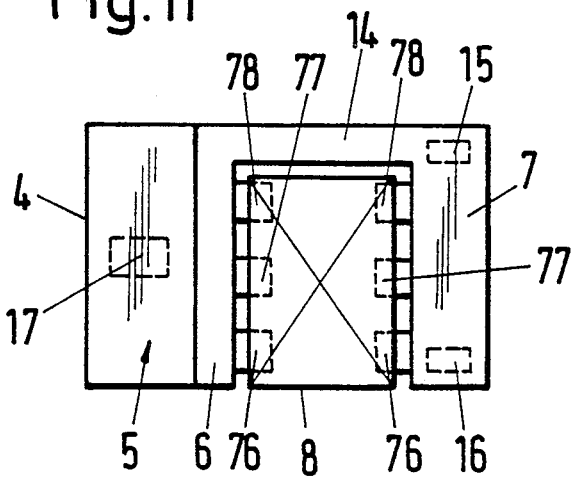
FIG. 11 is a top plan view showing an industrial truck which embodies the invention.

FIG. 11 shows an industrial truck 4 which is of the kind described hereinbefore and comprises the truck body 5, the driven steerable wheel 17 and the chassis beam 7 provided with the wheels 15, 16. The chassis beam 7 is connected by the longitudinal beam 14 to the chassis beam 6 and to the body 5 of the truck. A U-shaped recess is thus provided, on which the load carrier subassembly 8 can be outwardly extended.

FIG. 11 shows also the load supports 76 to 78 provided on both sides.

In the truck which has been described with reference hereinbefore the housing part in which the load carrier arms 21, 22 are guided is pivoted in the chassis by the provision of two rollers mounted on opposite sides and the actual support is provided in that the load is supported by the load-supporting rollers 23, 24; 45, 46. This will result in a substantial improvement over the known designs in that the structure is lighter in weight and the guidance is more reliable. In conjunction with a single double-acting cylinder-piston device 37 that embodiment has been provided with the object to ensure that said simple design permits a control of the lifting drive and of the drive for extending the load-supporting rollers.

Figure 12A:
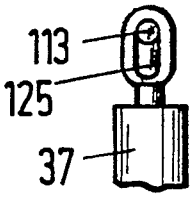
FIG. 12*a* shows a detail of FIG. 12.
Figure 12:
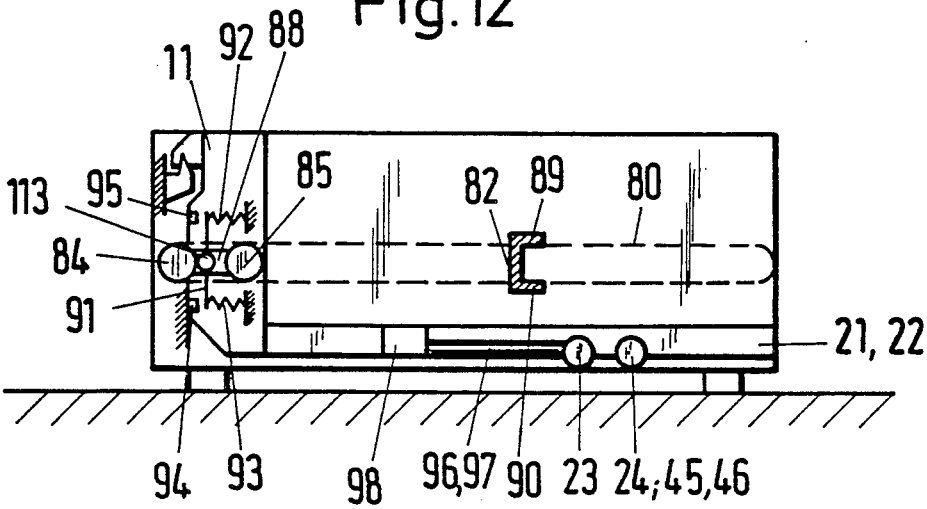
FIG. 12 is a diagrammatic fragmentary vertical longitudinal sectional view illustrating a special embodiment of the invention.
Figure 13:
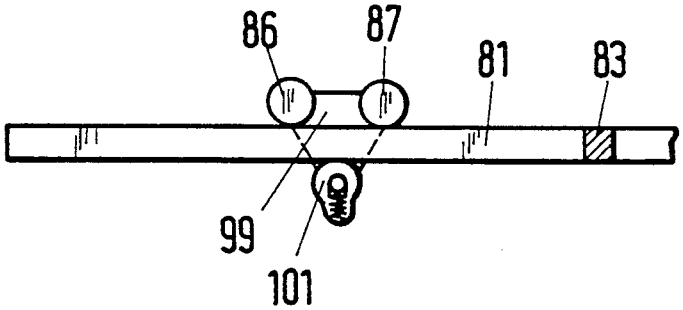
FIG. 13 is a fragmentary view showing elements of FIG. 12 in a different form for an explanation of another embodiment.

In special cases it may be desirable to initially extend the load carrier arms 21, 22 into pallets without a support by load-supporting rollers and in such a manner that a contact with transversely extending boards of the pallet will be avoided. For that purpose, FIGS. 12 and 13 show that guiding means 80, 81 are provided, which comprise an inwardly open channel bar 82 or a solid beam 83. In either case, two guide rollers 84, 85 (FIG. 12) or 86, 87 (FIG. 13) are provided. In the former case the two guide rollers run on a swivel carriage 88 within the flanges 89, 90 of the channel bar 82 so that the guide rollers will be able to hold the load carrier arms 21, 22 in a horizontal position even when the load-supporting rollers 23, 24; 45, 46 have been lifted from the ground. That feature will be adopted when rather loads are to be handled. In that case the load-supporting rollers 23, 24; 45, 46 can selectively be extended by a special drive 98 after the load carrier arms have been extended into or under a pallet and the load is to be picked up. That special drive 98 may consist, e.g., of a screw drive.

The pivoted carriage constitutes a guide for the movement of the load carrier arms 21, 22 and may rigidly be connected to such arms. The term swivel carriage suggests a certain adaptability, which is preferred because the load carrier arms 21, 22 will then be able to yield to some extend under a load which is heavier than normal. In that case the load carrier arms will also be able to yield when they are moved with a load applied and the load-supporting rollers are moving over a substantially uneven ground. In order to permit a guidance of the load carrier arms 21, 22 in a horizontal orientation, the swivel carriage 88 comprises outwardly directed rigid feelers or stops 91, which at their ends are supported on springs 92, 93, which at their other end are supported in the housing 11. As a result, the load carrier arms 21, 22 will be maintained in an intermediate horizontal orientation in dependence on the strength of the springs 92, 93. If a heavy load, as described, or a misoperation, would tend to deflect the housing from said intermediate position, limit stops 94, 95 will cooperate with the rigid feelers or stops 91, which are also mounted in the housing. In dependence on the selection of the distance between the feelers or stops 91 and the limit stops 94, 95, a contact between said elements may be utilized to control a drive. For instance, the lower limit stop 94 may be provided with a contact which can be closed to initiate the operation of the extending drive 98 for extending the load-supporting rollers 23, 24 or also 45, 46 on the other side of the truck.

In that embodiment, a lever for carrying the load-supporting rollers is pivoted in known manner to each load carrier arms 21, 22 and is connected to a tension linkage 96, 97, which is operatively connected to an associated drive. The latter drive may be a hydraulic piston drive or a motor for driving a nut that is in threaded engagement with a screw that constitutes an end of the tension linkage.

In order to ensure a controlled transmission of force between the knife edge bearing 20 and the suspension hook 19 whereas the guide rollers 84, 85 are left in position within the channel bar 82, that embodiment comprises a joint including a slot for the connection to the lifting drive, which may consist, e.g., of a cylinder-piston device 37 (FIG. 16). The piston rod 112 of such drive may be formed with a slot 125 rather than as is shown with an eye in FIG. 16 and said slot receives an intermediate rod 113 of the swivel carriage 88. That specific design is shown in FIG. 12*a*.

FIG. 13 shows a solid beam 83, on the top of which the guide rollers 86, 87 run. These are mounted on a beam 99, which correspond to the swivel carriage 88 in FIG. 12. A spring-loaded back-pressure roller 101 is mounted on the bottom of the beam 99 and urges the two guide rollers 86, 87 against the top surface 110 of the solid beam 83 to ensure that load carrier arms 21, 22 not shown in detail in FIG. 13 will be constrained to move in parallel.

What is claimed is:

1. An industrial truck having a laterally extending contour and arranged for picking up a laterally disposed load, comprising a chassis including two transversely extending chassis beams (6, 7) and a longitudinally extending beam (14), which connects the transversely extending chassis beams (6, 7), wheels (15 to 17), which are disposed under the chassis beams (6, 7) and at least one (17) is driven and steerable, a laterally extensible and retractable load carrier subassembly (8) comprising a forked load carrier including at least one load carrier arm (21, 22; 109), guiding means, which are provided on confronting sides of the chassis beams and adapted to guide the load-carrier subassembly on both sides in a lateral direction, an extending drive for laterally extending and retracting the load carrier subassembly beyond the laterally extending contour of the truck, stop means for limiting the extending and retracting of said load carrier subassembly, a lifting drive (37) for vertically moving the load carrier subassembly (8) relative to at least one said chassis beam, downwardly extensible load-supporting rollers (23, 24; 45, 46) adapted to be supported on the ground under the truck, which load-supporting rollers (23, 24; 45, 46) for supporting the load carrier arms (21, 22) are mounted on said load carrier arms (21, 22) and included in the load carrier subassembly, drive means for downwardly extending the load-supporting rollers (23, 24; 45, 46), guide tracks (18, 35, 36) on said chassis beams, and guide rollers (33, 34) for guiding said load carrier arms on said tracks and said guide rollers being upwardly displaceable from said guide tracks, said lifting drive (37) comprises a double-acting cylinder-piston device connected at one end to a fork crosspiece housing (11) which is included in said load carrier and carries said load carrier arms and at the other end to beam means extending through said housing and comprising a crossbar (30) and a transverse rod, said beam means carrying said guide rollers (33, 34) adapted to be supported on and to be lifted from said guide tracks (35, 36), slotted cam plates (40, 41) are carried by said beam means, pivoted arms for adjusting an adjusting linkage are guided in cam slots formed in said slotted cam plates and are connected to said drive for extending said load-supporting rollers (23, 24), and said fork crosspiece housing (11) is vertically movable relative to said beam means.

2. An industrial truck according to claim 1, comprising:

a lifting frame, which is mounted on the laterally extensible load carrier subassembly, a fork crosspiece housing, which is included in the load carrier and carries said load carrier arms, a carriage, which carries the fork crosspiece housing and which is vertically movable on the lifting frame along guide means, carriage drive means for vertically moving the carriage relative to the lifting frame, wherein said load carrier comprises said roller-carrying arms (110, 111), and said load-supporting rollers are mounted on the roller-carrying arms and are downwardly extensible independently of the lifting movement of the load carrier.

3. An industrial truck according to claim 1, wherein:

said chassis is provided with suspension means (19) for suspending the load carrier subassembly (8) in a retracted position, said forked load carrier including a fork cross-piece housing (11) carrying said load carrier arms and bearing means (20) for cooperating with the suspension means (19) provided on the chassis to provide a suspension gear, which in response to a vertical movement of the retracted load carrier subassembly is engageable with suspension means provided on the load carrier.

4. An industrial truck according to claim 3, wherein said forked load carrier (21, 22) comprises roller-carrying arms and load carrier arms (109) adapted to be supported by said roller-carrying arms.

5. An industrial truck according to claim 1, wherein:

said truck is provided along at least side edges of said chassis beams with load supports (48, 49; 76 to 78), which define recesses between them and are adapted to support loads which have been retracted by said load carrier into said industrial truck and said load-supporting rollers (23, 24; 45, 46) are arranged to be movable in said recesses.

6. An industrial truck according to claim 1, wherein said lifting drive (37) for the load carrier subassembly is operatively connected to a mechanism (40, 41; 58, 60, 61) for extending and detracting the load-supporting rollers (23, 24) in such a manner an operation of said lifting drive (37) to move the load carrier subassembly in an upward direction will cause the mechanism (40, 41; 58, 60, 63) for extending the load-supporting rollers (23, 24) to downwardly extend said load-supporting rollers.

7. An industrial truck according to claim 1, wherein said load-supporting rollers (23, 24) are mounted on a support, which is provided with a limit stop for limiting the retracting movement of the load carrier and for defining for the double-acting cylinder-piston device (37) an end position in which said guide rollers (33, 34) are lifted from said tracks (35, 36).

8. An industrial truck according to claim 1, wherein said load carrier includes a fork crosspiece housing carrying said load carrier arms (21, 22), guiding means (80, 81) are provided on said chassis beams (6, 7), a roller guide is provided between said load carrier subassembly (8) and said guide means (80, 81) and is arranged to guide said fork crosspiece housing with said load carrier arms in a horizontal orientation, and a separate extending and retracting drive (98) is provided for extending and retracting said extensible load-supporting rollers (23, 24; 45, 46).

9. An industrial truck according to claim 8, wherein:

said roller guide comprises at least two roller guide rollers (84, 85), said roller guide rollers are mounted on a swivel mount that is pivoted to said fork crosspiece housing (11), and springs (92, 93) are connected to the roller guide rollers and tend to maintain the roller guide in a position in which said roller guide is parallel to said load carrier arms.

10. An industrial truck according to claim 9, wherein:

stops (94, 95) are provided for limiting the pivotal movement of the two roller guide rollers (84, 85), said guide means comprise channel bars (82), which are disposed on opposite sides of and open toward said fork crosspiece housing (11) and said roller guide rollers (84, 85) are received by and movable in and along said channel bars.

11. An industrial truck according to claim 8, wherein:

said roller guide comprises guide means (80, 81) including two solid beams (83) and a carriage (99) associated with each of said solid beams (83) and connected to said fork crosspiece housing (11), and said guide means further comprising guide rollers (86, 87), which are mounted on said carriage and adapted to run on said solid beams, and a spring-loaded back pressure roller (101), which is mounted on said carriage (99) and applies pressure to the underside of said solid beam (83).

* * * * *